US006779591B2

(12) United States Patent
Ehlers et al.

(10) Patent No.: US 6,779,591 B2
(45) Date of Patent: Aug. 24, 2004

(54) COMPACT HEAT EXCHANGER FOR A COMPACT COOLING SYSTEM

(75) Inventors: Michael Ehlers, Nagold (DE); Wolfgang Knecht, Stuttgart (DE); Daniela Fischer, Zell (DE); Roland Strähle, Unterensingen (DE); Jörg Soldner, Ehningen (DE); Werner Zobel, Böblingen (DE); Mark G. Voss, Franksville, WI (US); Frank Vetter, Filderstadt (DE)

(73) Assignee: Modine Manufacturing Company, Racine, WI (US)

( * ) Notice: Subject to any disclaimer, the term of this patent is extended or adjusted under 35 U.S.C. 154(b) by 40 days.

(21) Appl. No.: 09/929,577

(22) Filed: Aug. 14, 2001

(65) Prior Publication Data

US 2002/0023730 A1 Feb. 28, 2002

(30) Foreign Application Priority Data

Aug. 25, 2000 (DE) ..... 100 41 795
Aug. 25, 2000 (DE) ..... 100 41 794

(51) Int. Cl.[7] ..... F28F 1/00

(52) U.S. Cl. ..... 165/41; 165/51; 165/140; 165/125; 165/175; 165/178; 165/173; 123/41.49

(58) Field of Search ..... 165/178, 173, 165/175, 41, 51, 110, 125, 140; 123/41.49

(56) References Cited

U.S. PATENT DOCUMENTS

| | | | | | |
|---|---|---|---|---|---|
| 1,853,314 | A | * | 4/1932 | Modine | 165/175 |
| 3,034,770 | A | * | 5/1962 | Hiersch | 165/103 |
| 3,921,603 | A | * | 11/1975 | Bentz et al. | 165/51 |
| 4,062,401 | A | * | 12/1977 | Rudny et al. | 165/125 |
| 4,969,512 | A | * | 11/1990 | Hisao et al. | 165/175 |
| 4,977,956 | A | * | 12/1990 | Aoki et al. | 165/175 |
| 5,095,972 | A | * | 3/1992 | Nakaguro | 165/175 |
| 5,101,890 | A | * | 4/1992 | Aoki et al. | 165/175 |
| 5,275,236 | A | * | 1/1994 | Le Gauyer | 165/178 |
| 5,372,188 | A | * | 12/1994 | Dudley et al. | 165/110 |
| 5,458,190 | A | * | 10/1995 | Sasaki et al. | 165/110 |
| 5,755,189 | A | | 5/1998 | Godeau et al. | 123/41.01 |
| 5,868,198 | A | * | 2/1999 | Kato | 165/175 |
| 6,129,056 | A | * | 10/2000 | Skeel et al. | 123/41.49 |
| 6,164,909 | A | * | 12/2000 | Ehlers et al. | 165/41 |

FOREIGN PATENT DOCUMENTS

| | | | | |
|---|---|---|---|---|
| DE | 2921607 | | 11/1980 | |
| DE | 4118463 | | 12/1991 | |
| DE | 4205234 | | 8/1993 | |
| DE | 4212070 | | 10/1993 | |
| DE | 29504867 | | 8/1996 | |
| DE | 19527050 | | 1/1997 | |
| DE | 19724728 | | 2/1999 | |
| DE | 19950753 | | 4/2001 | |
| EP | 0222636 | | 3/1989 | |
| JP | 3-79994 | * | 4/1991 | 165/178 |
| JP | 3-168590 | * | 7/1991 | 165/178 |
| JP | 4-369388 | * | 12/1992 | 165/175 |
| JP | 6-273088 | * | 9/1994 | 165/178 |
| JP | 8-136 176 | * | 5/1996 | |
| JP | 10-197190 | * | 7/1998 | |

* cited by examiner

*Primary Examiner*—John K. Ford
(74) *Attorney, Agent, or Firm*—Wood, Phillips, Katz, Clark & Mortimer

(57) ABSTRACT

A heat exchanger including a first header having an inlet therein, a second header, an outlet in one of the first and second headers, and a plurality of flat tubes extending between the first and second headers for carrying a fluid between the first and second headers. A first connector is also provided for connecting a first exterior line to one of the first and second headers, the first connector being proximate and substantially parallel to an end of one of the flat tubes. In a compact cooling system, such heat exchangers may be disposed about a radial fan directing air flow outwardly away from the fan axis. One of a system inlet and a system outlet are connected via the first exterior lines to the first connectors of at least two of the heat exchangers.

14 Claims, 12 Drawing Sheets

COMPACT HEAT EXCHANGER FOR A COMPACT COOLING SYSTEM

BACKGROUND OF THE INVENTION

The invention relates to heat exchangers, and more particularly to compact heat exchangers.

Heat exchangers are, in many applications, relatively unconstrained as to the space which they may take up, but in many other applications it is imperative to minimize their size so that they can fit in restricted spaces such as vehicle engine compartments. For example, compact cooling systems are sometimes used in vehicular applications and typically include a plurality of heat exchangers (e.g. radiators), for cooling engine coolant as well as to cool oil, cool turbo or supercharged combustion air and to provide air conditioning to the passenger compartment. Such heat exchangers are sometimes placed together with one another around a radial fan in a box-like configuration. In these and other applications, not only is the size of the heat exchanger important, but the space required for the various connecting lines is also important in minimizing space. Of course, in all instances, cost and ease and reliability of manufacture are important as well.

The present invention is directed toward one or more of the considerations set forth above.

SUMMARY OF THE INVENTION

In one aspect of the present invention, a heat exchanger is provided including a first header having an inlet therein, a second header, an outlet in one of the first and second headers, and a plurality of flat tubes extending between the first and second headers for carrying a fluid between the first and second headers. A first connector is also provided for connecting a first exterior line to one of the first and second headers, the first connector being proximate and substantially parallel to an end of one of the flat tubes.

In one form, the tubes are arranged in a row with the tubes disposed with facing flat sides, with the first connector secured to a portion of the one of the first and second headers extending beyond the tube row. In another form, a second connector is provided for connecting a second exterior line to the other of the first and second headers, with the second connector proximate and parallel to another of the flat tubes which is at opposite ends of the row to the one flat tube.

In another aspect of the present invention, a compact cooling system is provided, including a radial fan directing air flow radially outwardly away from the fan axis and a plurality of heat exchangers as described above disposed around the radial fan with their headers extending generally in the same direction as the fan axis with the plurality of flat tubes spaced from a system front to a system back across the air flow. One of a system inlet and a system outlet are connected via the first exterior lines to the first connectors of at least two of the heat exchangers.

In a form of this aspect of the invention, two connectors are provided in the headers with one first connector adjacent the system front and the other connector adjacent the system back.

In still another aspect of the present invention, a heat exchanger is provided including two headers, with at least one header having a laterally extending wall with a plurality of tube openings and a feed opening proximate an end one of the tube openings in the wall. A plurality of flat tubes are secured in the first header tube openings and extend between the first and second headers for carrying a fluid between the first and second headers. A first connector for connecting a first exterior line to one of the first and second headers is secured in the first header feed opening and extends substantially parallel to the flat tubes.

DETAILED DESCRIPTION OF THE INVENTION

Figure 1:
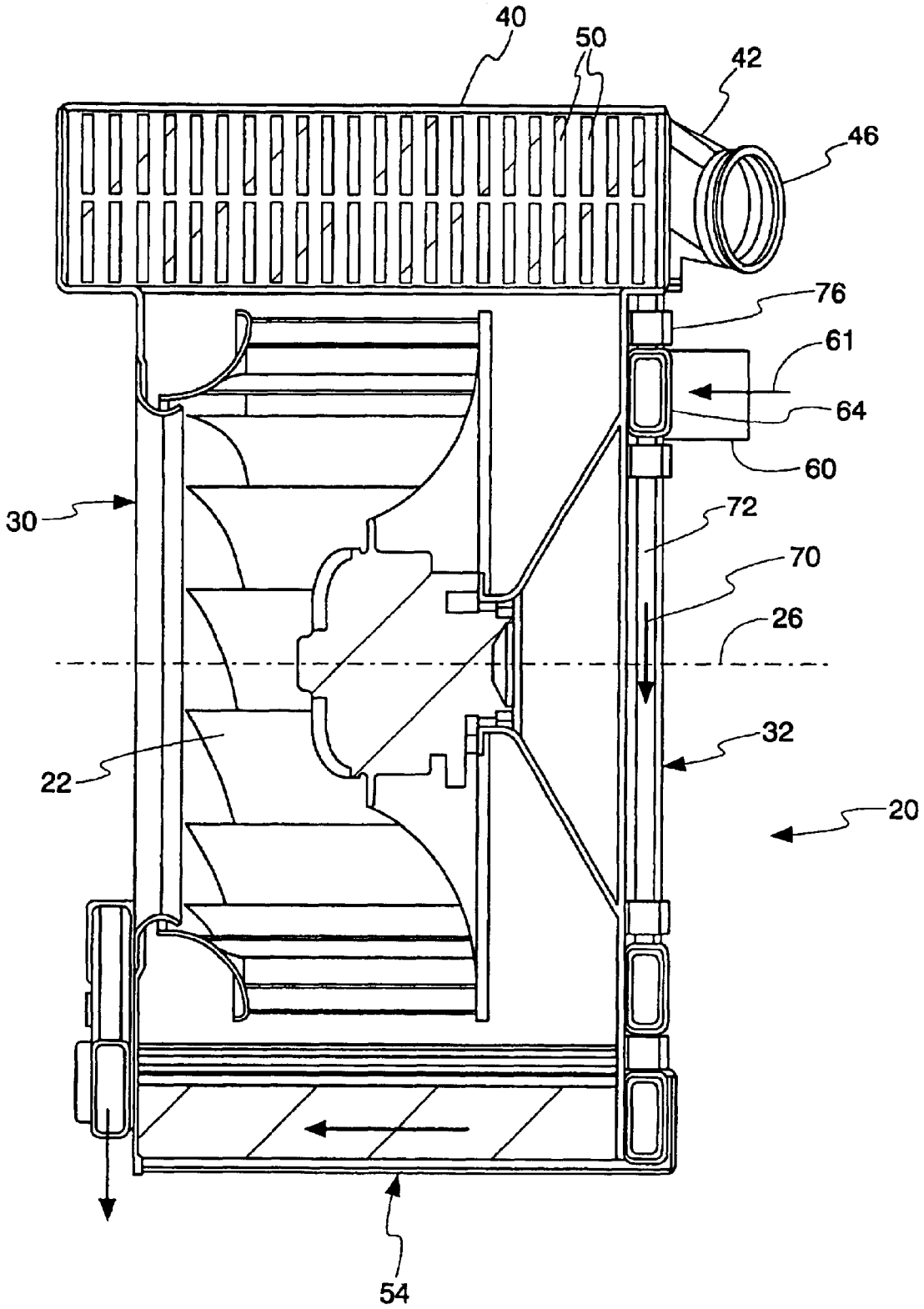
FIG. 1 is a vertical section through a compact cooling system incorporating the present invention.

One embodiment of a compact cooling system 20 incorporating heat exchangers according to the present invention is shown in FIGS. 1–5. While reference is made herein to a cooling system, it should nevertheless be understood that the invention could also be used with a compact system providing virtually any type of heat exchange.

The compact cooling system 20 includes a radial fan 22 which rotates about an axis 26 to direct air to flow radially out away from the axis 26. The compact cooling system 20 also includes a back or rear wall 30 and a front wall 32.

Supported around the fan 22 in the general shape of a rectangular box (though other shapes could be used) are a plurality of heat exchangers. Specifically, in the illustrated embodiment an upper heat exchanger 40 extends across the top which operates independently of the other heat exchangers (i.e., is not supplied from a common fluid source). Specifically, the upper heat exchanger 40 includes a pair of headers 42, 44, one with an inlet 46 and one with an outlet 48. The upper heat exchanger 40 may be, for example, a conventional charge air cooler for cooling turbocharged or supercharged engine combustion air. Though not shown in the Figures, the upper heat exchanger 40 commonly may include a plurality of suitable tubes extending between the headers 42, 44, with suitable fins extending between the tubes 50 (e.g., serpentine fins or plate fins), whereby the air flow in the upward direction caused by the fan 22 passes over the fins and tubes 50 to cool them and thereby cool the coolant passing through the tubes such as is well known in the art. Such cooling could be one or two phase, that is, a hot fluid (liquid or gas) in the tubes could be cooled (one phase) or a gas such as a refrigerant could be condensed (two phase). It should also be understood that heat transfer in the opposite direction could occur within the scope of the invention (i.e., a hot gas could be passed over the fins and tubes which convey a cool fluid). Most commonly, however, the compact cooling system 20 may be used with vehicles in which the ambient air is used to cool engine fluids.

In the FIGS. 1–5 embodiment, the other three sides of the compact cooling system 20 include three separate heat exchangers 52, 54, 56, each of which may be of generally a similar, generally identical configuration as described for the upper heat exchanger 40 (i.e., with a pair of headers, one with an inlet and the other with an outlet, with tubes extending between the headers and fins between the tubes as alternately illustrated in FIGS. 6–12 hereafter). It should also be understood, however, that within the broad scope of the invention it would be possible to use the present invention with multipass heat exchangers which, as is understood in the art, have the inlet and outlet in the same headers where there are even numbers of passes. These three heat exchangers 52, 54, 56 are, in the disclosed embodiment, substantially the same size with substantially the same tube sizes and numbers, and therefore to maximize the cooling capacity of the compact cooling system 20 it is desirable to maintain substantially the same coolant flow through each. This may be accomplished by providing substantially similar overall lengths of flow paths to and from the compact cooling system 20.

Specifically, there is a single coolant inlet 60 on the front of the compact cooling system 20. Coolant from whatever the compact cooling system 20 is used with (e.g., a vehicle engine) enters through the inlet 60 (in the direction of arrow 61) and from there is distributed to the heat exchangers 52, 54, 56 as follows:

1. Coolant passes (in the direction of arrow 62) through a relatively long horizontal feed line 64 connected to the inlet header 66 of one of the side or lateral heat exchangers 56 (see FIG. 4).
2. Coolant passes (in the direction of arrow 70) through a relatively long vertical feed line 72 connected to the inlet header 74 of the bottom heat exchanger 54.
3. Coolant passes through a short feed line 76 to the inlet header 78 at the top of the other lateral heat exchangers 52.

Figure 2:
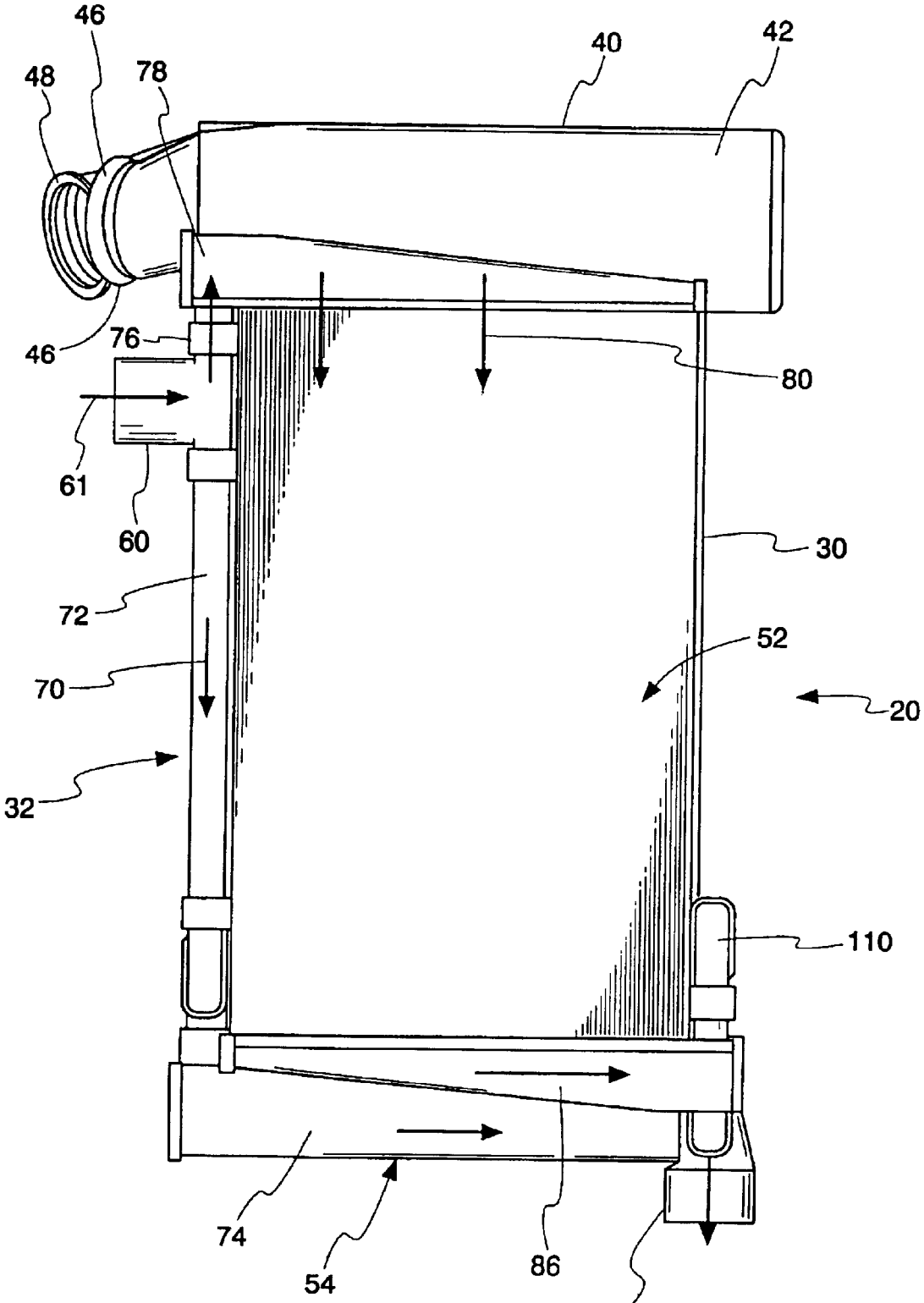
FIG. 2 is a side view of the compact cooling system shown in FIG. 1.
Figure 3:
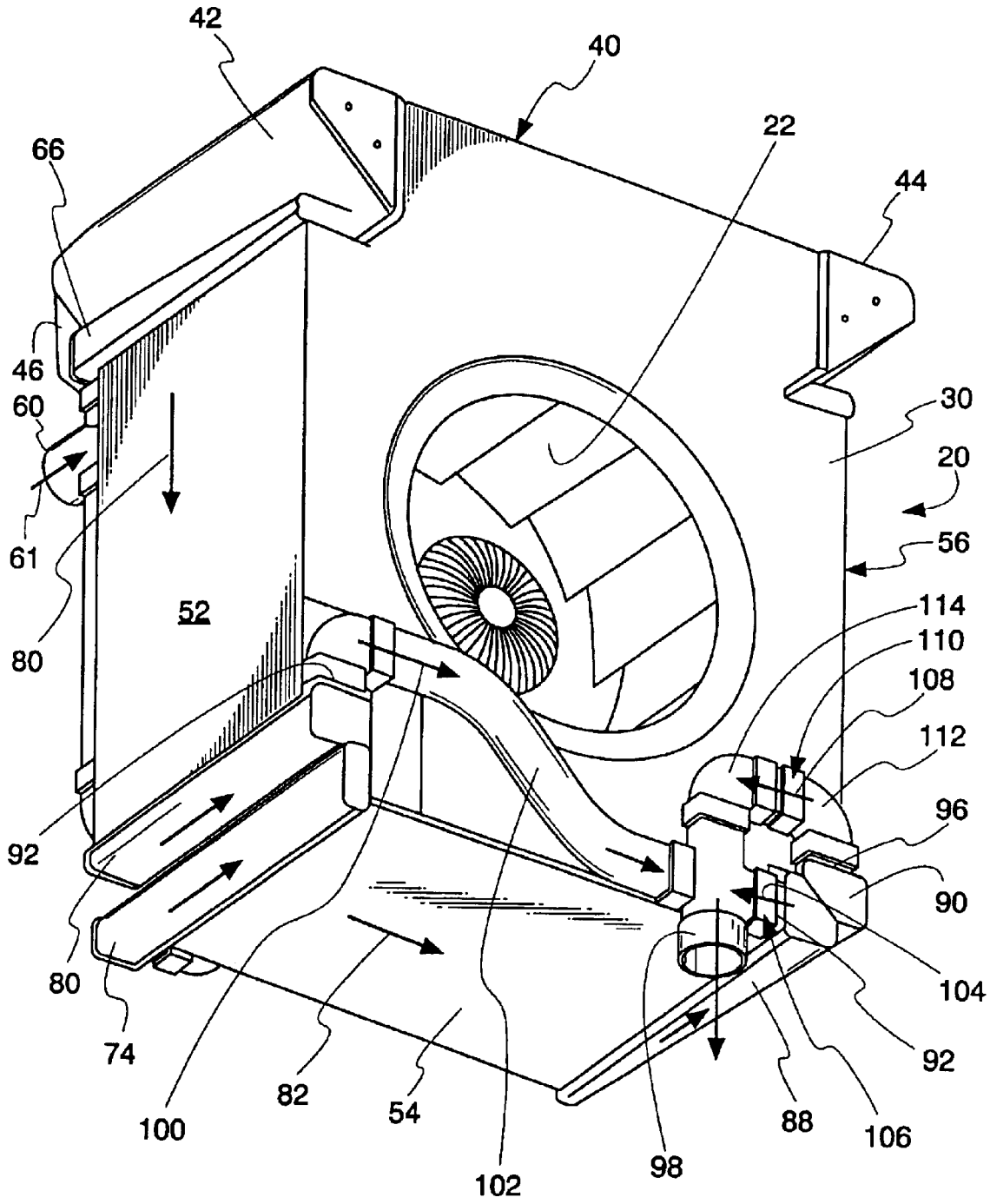
FIG. 3 is a rear perspective view of the compact cooling system shown in FIG. 1.
Figure 4:
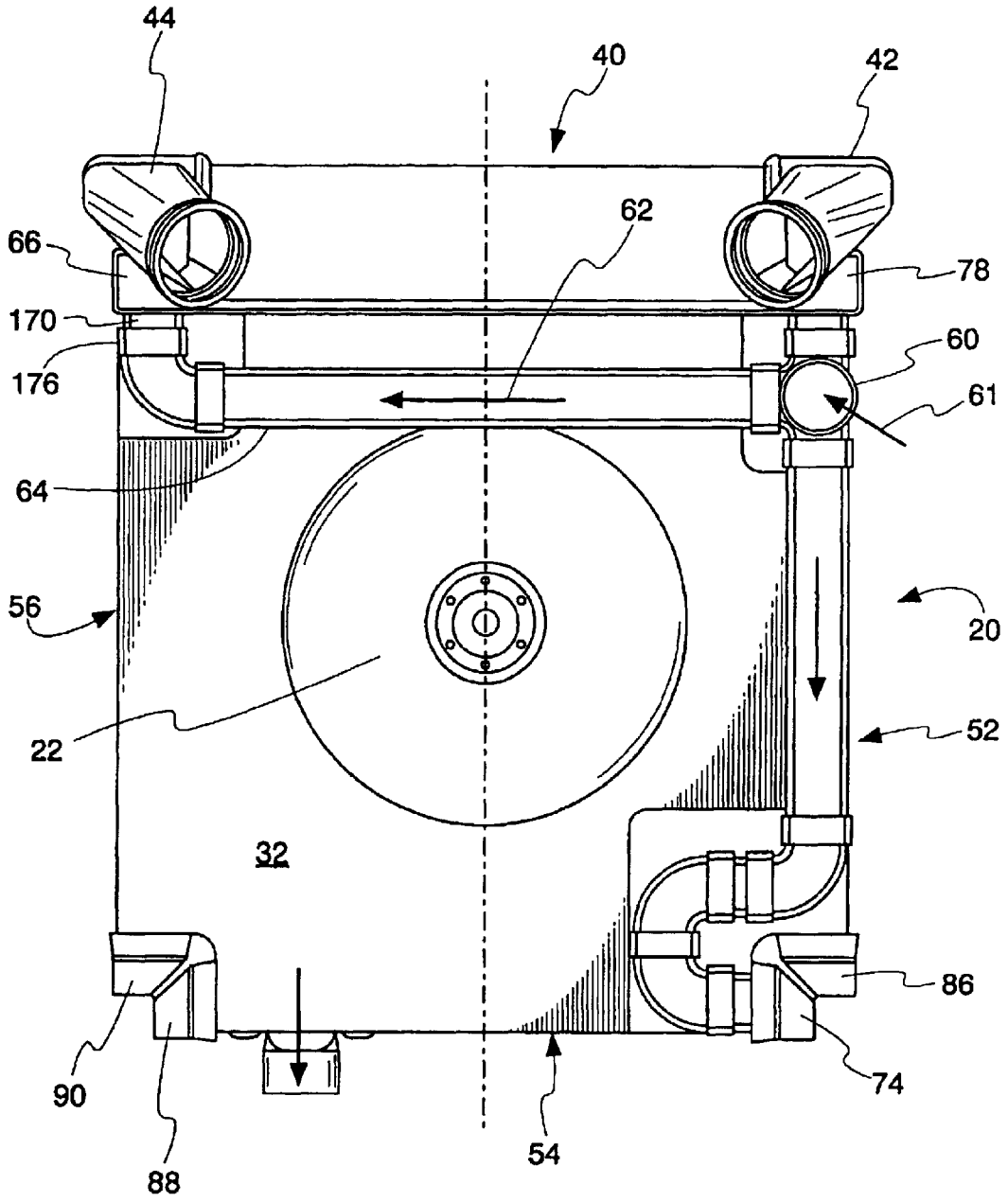
FIG. 4 is a front elevation view of the compact cooling system shown in FIG. 1.
Figure 5:
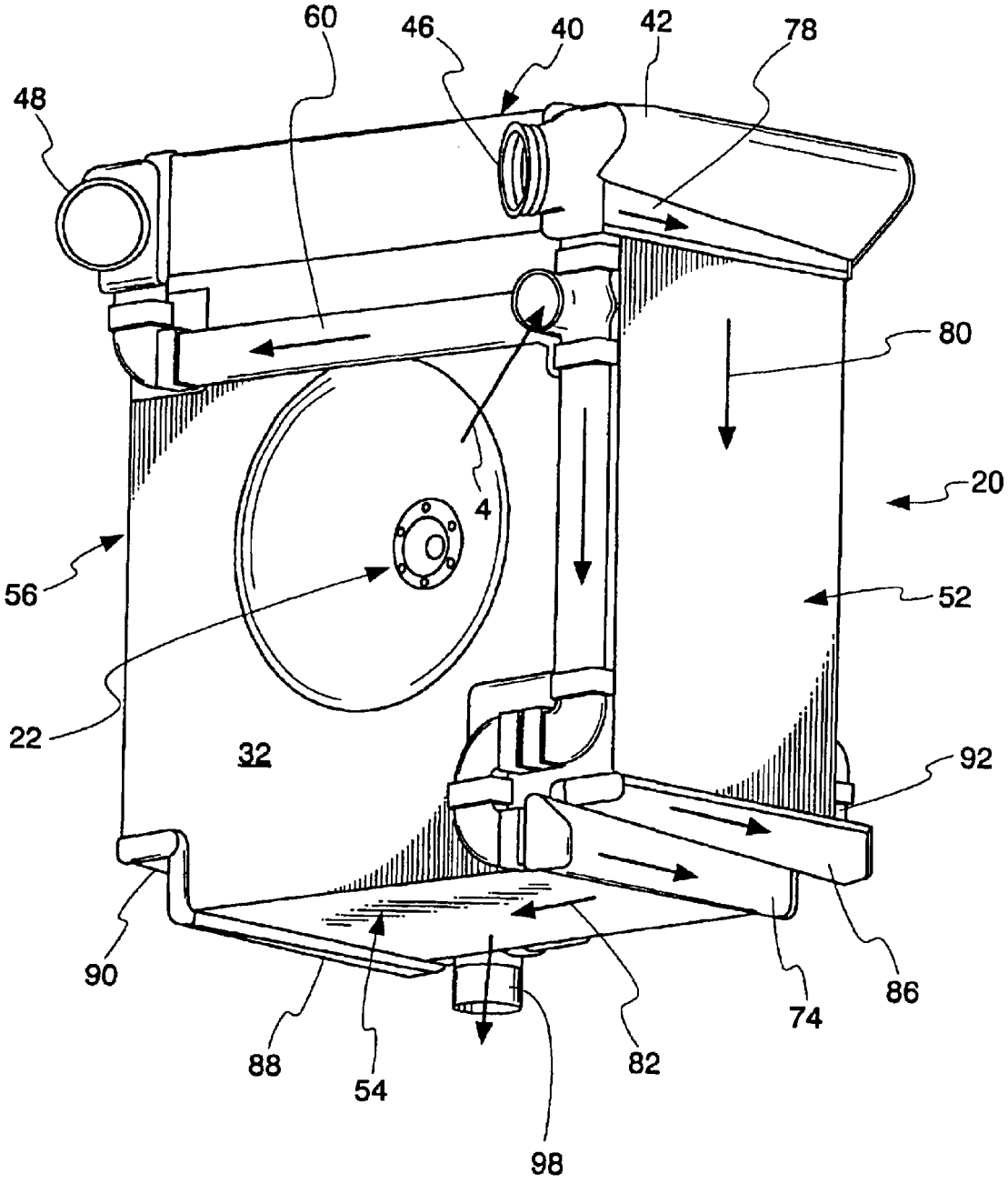
FIG. 5 is a front perspective view of the compact cooling system shown in FIG. 1.

In each of the inlet headers 66, 74, 78, the coolant is distributed such as is known to the previously described tubes and then passes through the tubes for cooling such as is known (in the direction of arrows 80, 82 in heat exchangers 52, 54 as shown in FIGS. 2, 3 and 5). The coolant exits the tubes into the outlet headers 86, 88, 90, all of which are located at the bottom of the compact cooling system 20 (the outlet headers 86, 90 are located at the bottom of the lateral heat exchangers 52, 56 and the outlet header 88 of the bottom heat exchanger 54 is at the end opposite its inlet header 74).

Each of the outlet headers 86, 88, 90 includes an outlet connection 92, 94, 96 from which the cooled coolant exits and from which it is collected at a single coolant outlet 98 as follows (see particularly FIGS. 3–5):

1. Coolant passes from the outlet header 86 of heat exchanger 52 (in the direction of arrow 100) through a relatively long generally horizontal feed line 102 connected to coolant outlet 98.
2. Coolant passes from the outlet header 88 of heat exchanger 54 (in the direction of arrow 104) through a very short feed line 106 connected to the coolant outlet 98.
3. Coolant passes from the outlet header 90 of heat exchanger 56 in the direction of arrow 108 through another short feed line 110 including two elbows 112, 114 and connected to the coolant outlet 98.

The various feed lines may be rectangular in cross section to provide a relatively flat outer surface and thereby allow the outer faces of the compact cooling system 20 to be compact with minimal bulges although it should be understood that other shapes could also be used within the scope of the invention. For example, where increased pressure resistance is required, the cross sections could be oval shaped or cylindrical. Further, the feed lines may also be of substantially similar size to provide similar flow resistance. As illustrated, the feed lines can be formed from various straight sections, bent sections, elbows, crosspieces, and the like suitably connected by sleeves, with such feed line components formed from any suitable manner dependent upon the coolant to be used (e.g., from materials capable of containing the coolant without unacceptable degradation resulting from corrosion and/or expected temperatures). For example, the feed line components such as sleeves, T-pieces, etc. could be formed by plastic injection molding whereas the longer feed lines could be extruded aluminum. Further, the lines may be flat rather than round to allow them to be located on the face of the compact cooling system without projecting outwardly from the face (e.g., to maintain a generally rectangular box outer shape), and the below described connectors similarly configured so that the various heat exchangers may be suitably connected to one another and/or to the source of coolant fluid in a modular fashion.

It should now be appreciated that the radial air flow caused by the fan 22 will cause air to pass through all four heat exchangers 40, 52, 54, 56 for advantageous cooling with all four. It should also be appreciated that the compact cooling system 20 can be advantageously manufactured using the four heat exchangers 40, 52, 54, 56 on all four sides. Further, as variously seen in FIGS. 2–5, the headers of the heat exchangers may be arranged snugly against one another to prevent air flow therebetween, thereby ensuring that maximum air flow generated by the fan 22 may occur where it is desired, through the tubes and fins of the heat exchangers.

Also, it should also be recognized that of the three heat exchangers 52, 54, 56 which operate in parallel with a single inlet 60 and a single outlet 98 will all have relatively identical flow paths for the coolant between the inlet 60 and the outlet 98. That is, the heat exchangers themselves provide substantially the same path (e.g., with similar headers and similar tubes). Further, the flow outside the heat exchangers is also substantially the same with flow between the inlet 60 and outlet 98 occurring through a relatively long and relatively short feed line for each of the three heat exchangers 52, 54, 56 operating in parallel. This is the subject matter of the related Ehlers et al. application entitled "Compact Cooling System with Similar Flow Paths for Multiple Heat Exchangers", filed concurrently herewith. The complete disclosure of that application is hereby incorporated by reference. From the disclosure, as illustrated further therein, it can be seen that a compact cooling system can be variously otherwise configured (e.g., with only two heat exchangers operating in parallel, with those heat exchangers positioned end to end at a corner or on opposite sides of the compact cooling system).

Figure 6:
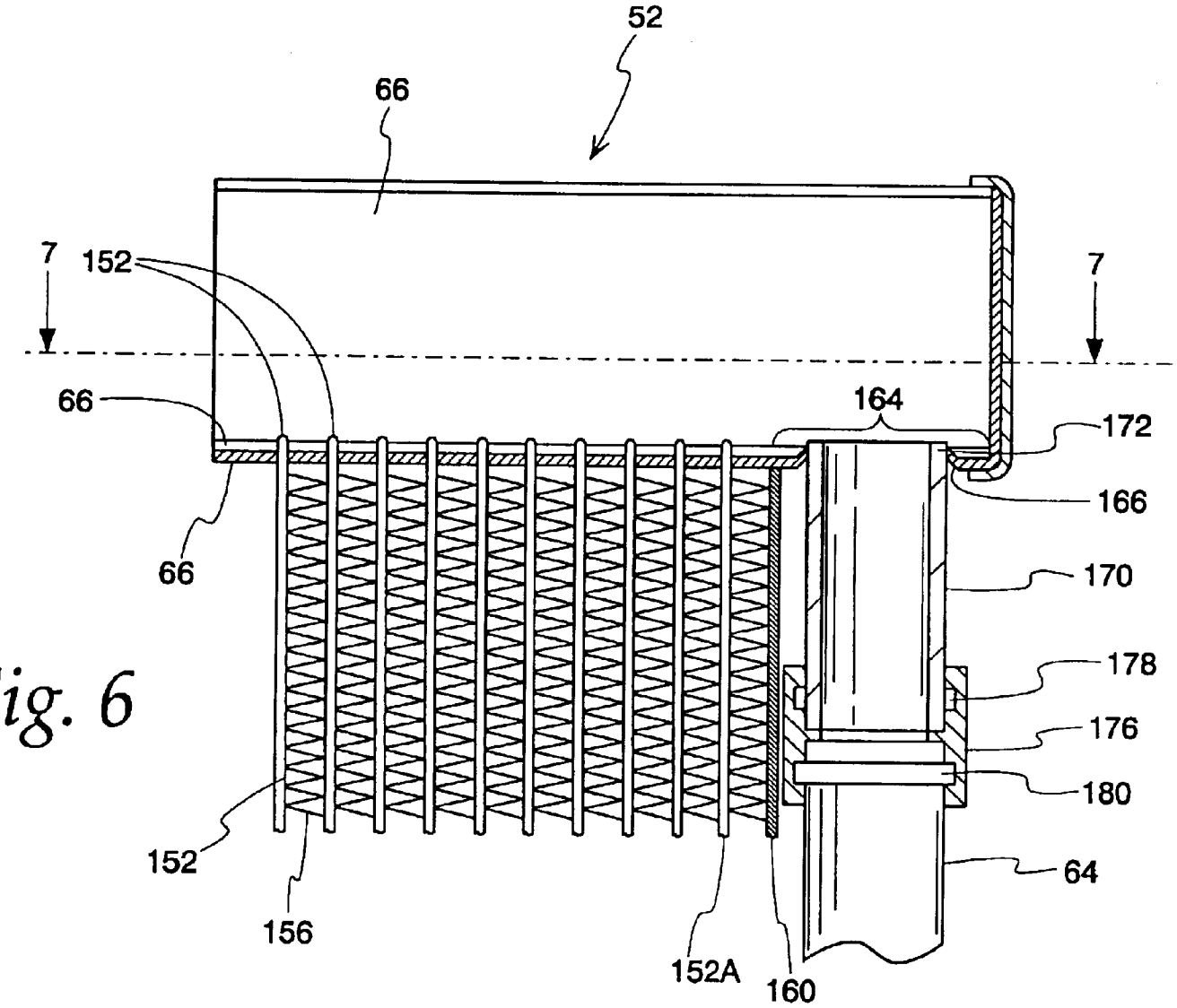
FIG. 6 is a partial cross-sectional view of a portion of one of the heat exchangers of the compact cooling system of FIG. 1.
Figure 7:
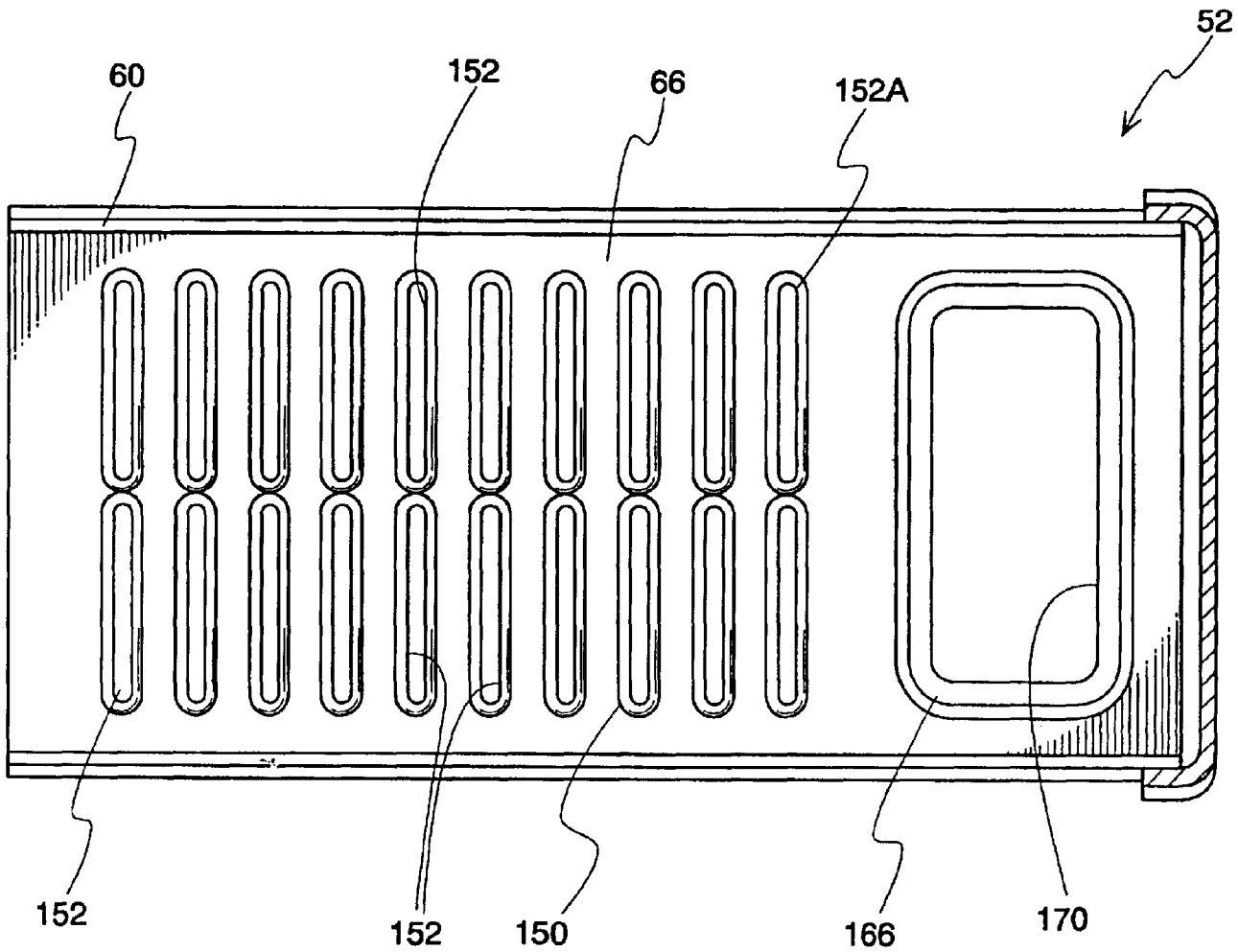
FIG. 7 is a cross-sectional view taken along line 7—7 of FIG. 6.
Figure 8:
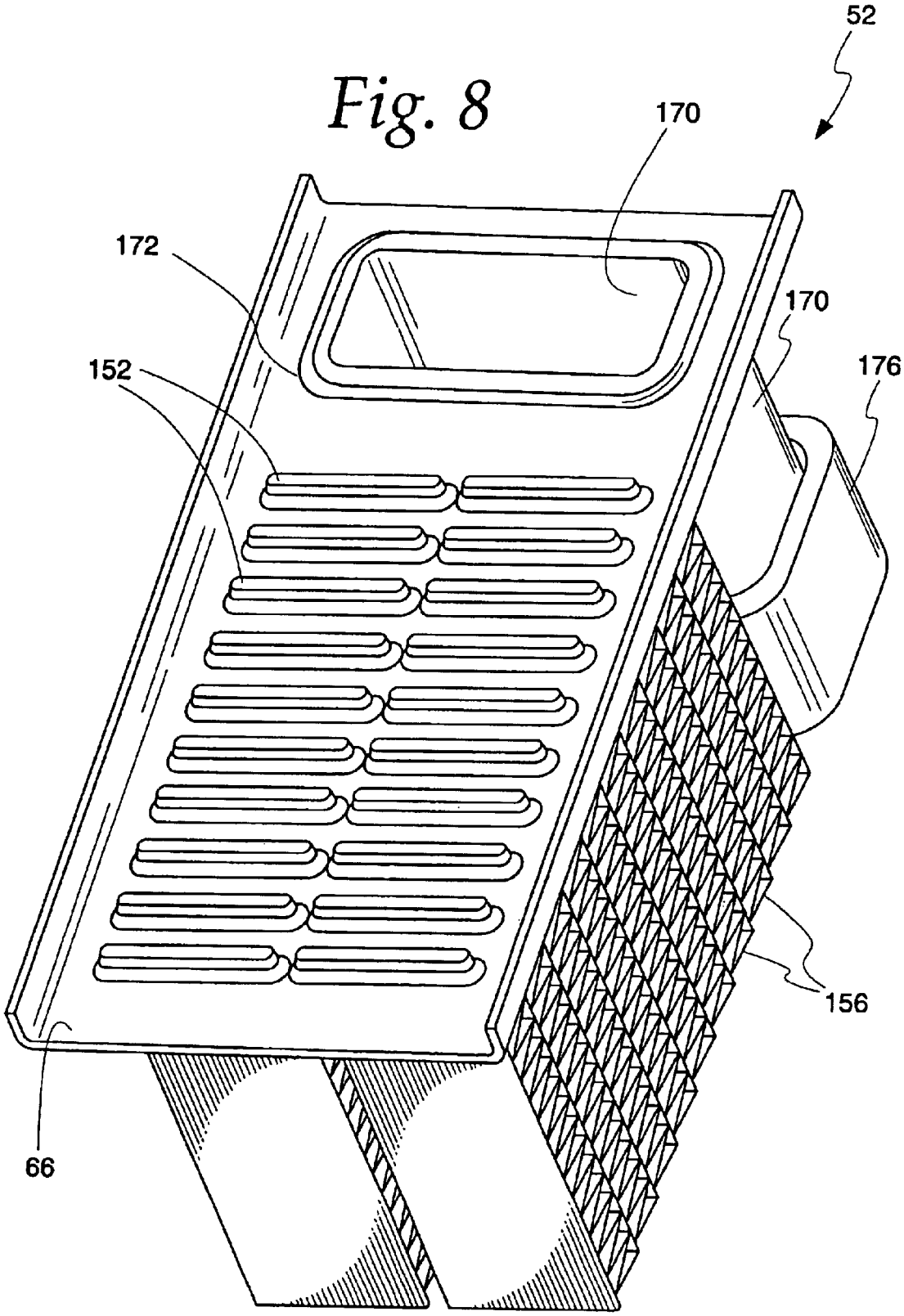
FIG. 8 is perspective partially broken view of the heat exchanger portion illustrated in FIGS. 6–7.

It should be appreciated, however, that for compact cooling systems such as described above, and for many other applications and uses of heat exchangers, the illustrated heat exchangers 52, 54, 56 provide connections for the feed lines which allow for compact size even when multiple heat exchangers 52, 54, 56 are variously combined in different configurations. FIGS. 6–8 illustrate in detail an advantageous connection structure provided in accordance with the present invention. For convenience of reference here, reference is made to the inlet header 66 of the heat exchanger 52 (and corresponding reference numerals are used where appropriate). However, it should be understood that the construction illustrated therein could be used for any or all of the heat exchangers 52, 54, 56, for either or both of their headers (including those connections highlighted by circles in FIGS. 1–5).

Specifically, the heat exchanger 52 includes suitable openings 150 in which a plurality of flat tubes 152 are suitably secured. As one example used for illustrative purposes only, the openings 150 may include flanges therearound, with the tubes 152 inserted through the openings 150 and then soldered (or brazed, or glued, or welded, etc., depending upon the materials of the components) thereto in a suitable leak-proof manner. It should, however, be understood that there are a wide variety of manners of securing heat exchanger tubes to the headers, and the present invention is not limited to any particular manner of doing so. As is well known in the art, the tubes 152 have passages therethrough which are open to the inlet header 66 so that fluid such as engine coolant will pass from the inlet header 66 into the tube passages, and will travel through the tubes to their other end, where it will be discharged into the outlet header 86. A substantially similar construction would be used at the connection of the tubes 152 to the outlet header 86, where the fluid will be discharged from the tube passages into the outlet header 86.

The tubes 152 are arranged in two rows (see FIG. 7) with their flat sides facing one another. One or more tube rows could be used with the present invention. The tube rows include a last tube 152*a*.

Suitable fins 156 are secured between the tubes 152 and provide good heat transfer resulting from the passage of air from the radial fan 22 over the tubes 152 and fins 156 as is well known. Serpentine fins 156 are illustrated, but it should be understood that the present invention could be advantageously used with virtually any fins providing heat transfer surfaces. For example, plate fins could also advantageously be used dependent upon the tubes used. A side piece 160 may also be provided against the fins 156 on the outer side of the last tube 152*a* to permit those fins 156 to be properly secured.

The header 66 includes an extension or protrusion 164 extending beyond the ends of the tube rows (i.e., beyond the last tube 152*a* and side piece 160). An opening 166 is provided in the protrusion 164 adjacent to the end of the tube rows into which the end of a connector 170 fits and is suitably secured. For example, a flange 172 may be provided around the opening 166, with the connector 170 secured thereto by soldering or brazing or other suitable manner, similar to the tubes 152. As the term is used herein, the connector 170 is "indirectly proximate" to the last tube 152*a* because it is proximate to the last tube 152*a* with only the last fins and the side plate 160 therebetween. Further, it will be seen that the connector 170 is in line with the tubes 152 (i.e., extends in the same direction as the tubes from the header).

It should be appreciated that this configuration will allow for the feed lines to be secured to the heat exchanger 52 without unnecessary protrusion beyond, for example, the generally box-shaped envelope of the compact cooling system 20. In fact, whatever the space requirements in which such a heat exchanger 52 is being used, the arrangement of the connector 170 such as shown will ensure that the feed lines which must be connected to the header 66 will potentially be of minimal concern inasmuch as the feed lines can be disposed flush against the side of the heat exchanger 52 with space being required for only the relatively small thickness of the feed line.

The feed line 64 may be suitably secured to the connector 170 such as illustrated in FIG. 6. Specifically, the feed line 64 (in this case an elbow piece such as shown in the upper left of FIG. 4) is aligned with the end of the connector 170 and secured thereto by a sleeve 176. Seals 178, 180 may also be provided therearound to ensure that there is no leakage through the connection.

Figure 9:
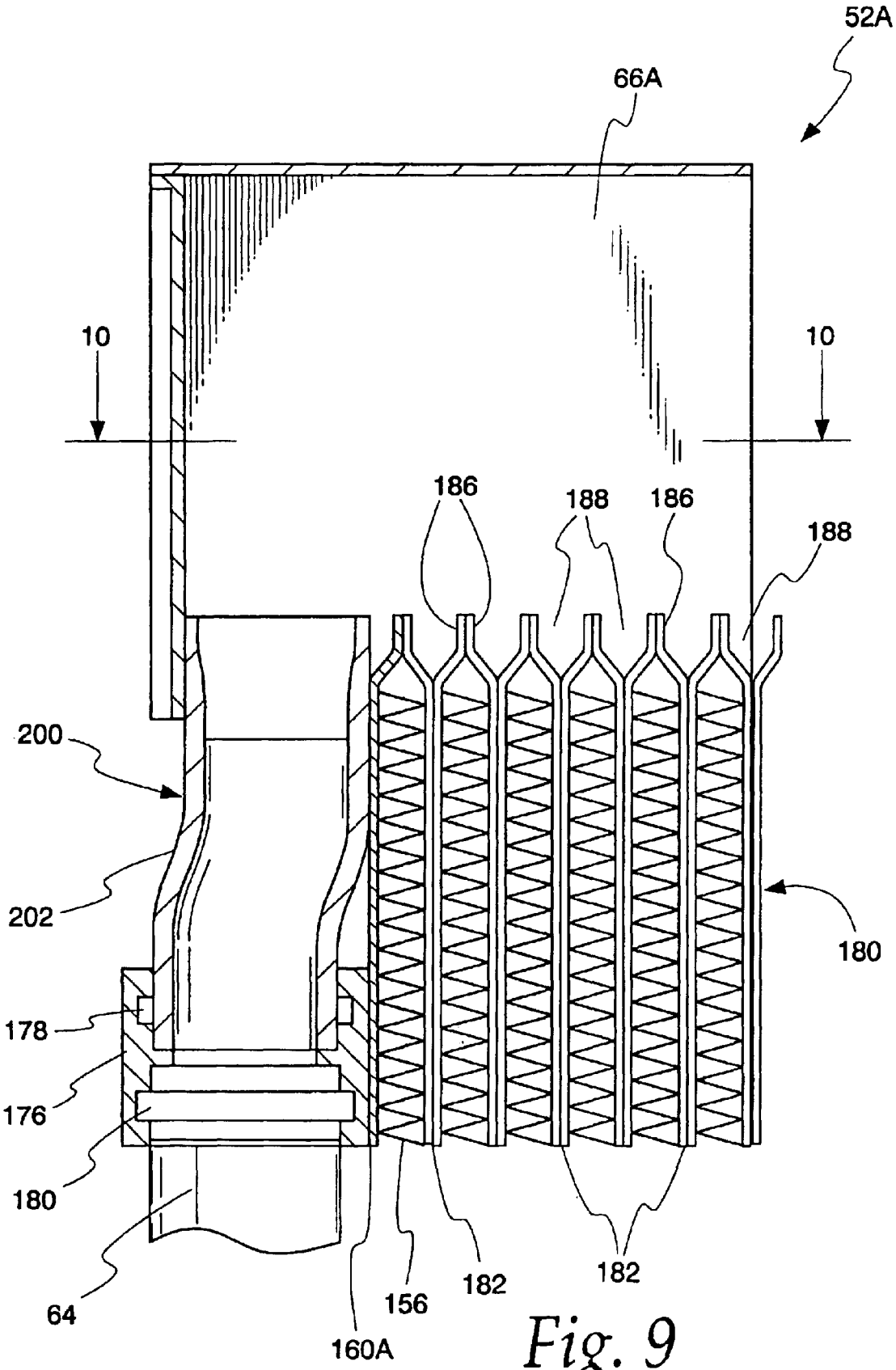
FIG. 9 is a partial cross-sectional view of a portion of an alternative heat exchanger usable with the compact cooling system of FIG. 1.
Figure 10:
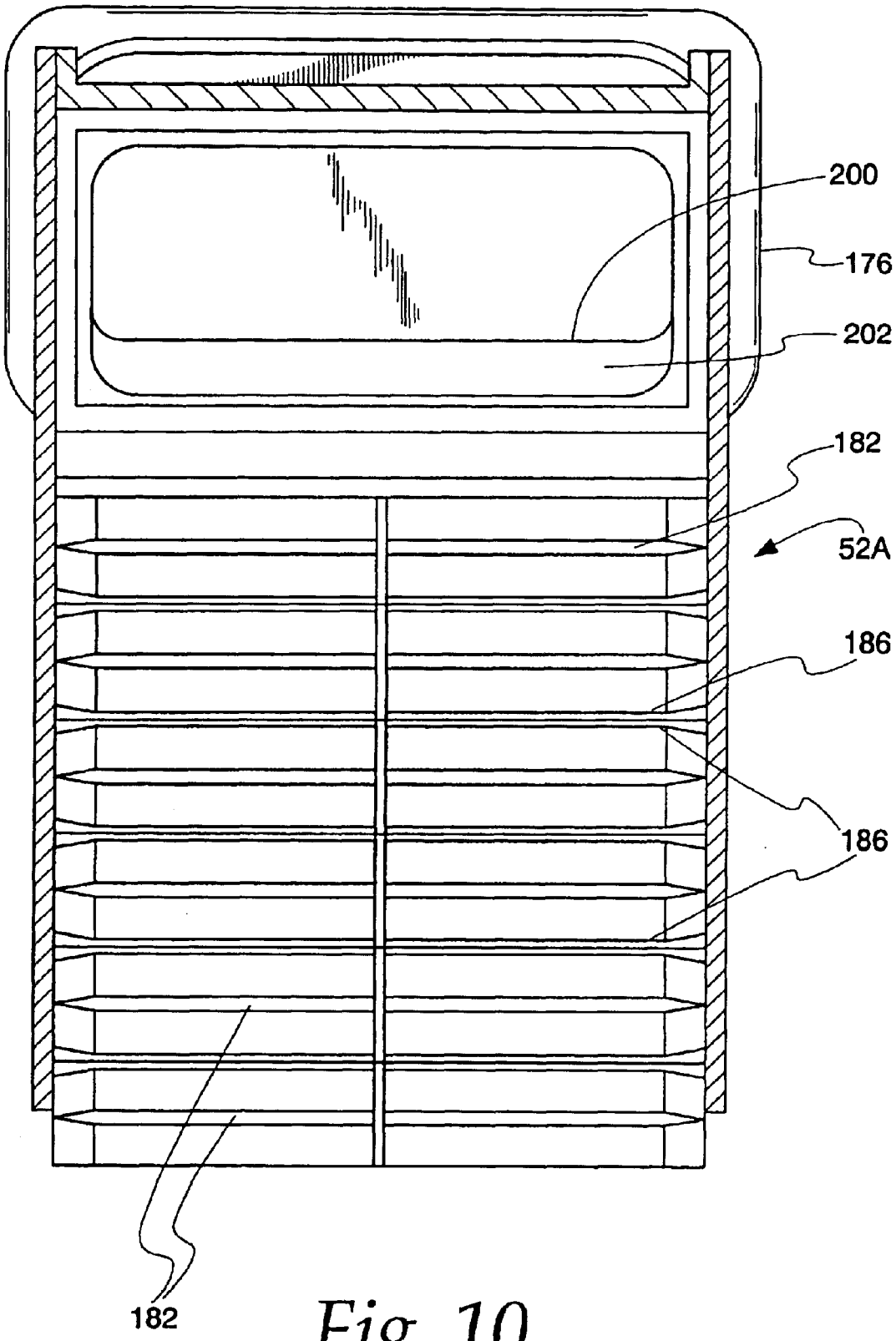
FIG. 10 is a cross-sectional view taken along line 10—10 of FIG. 9.
Figure 11:
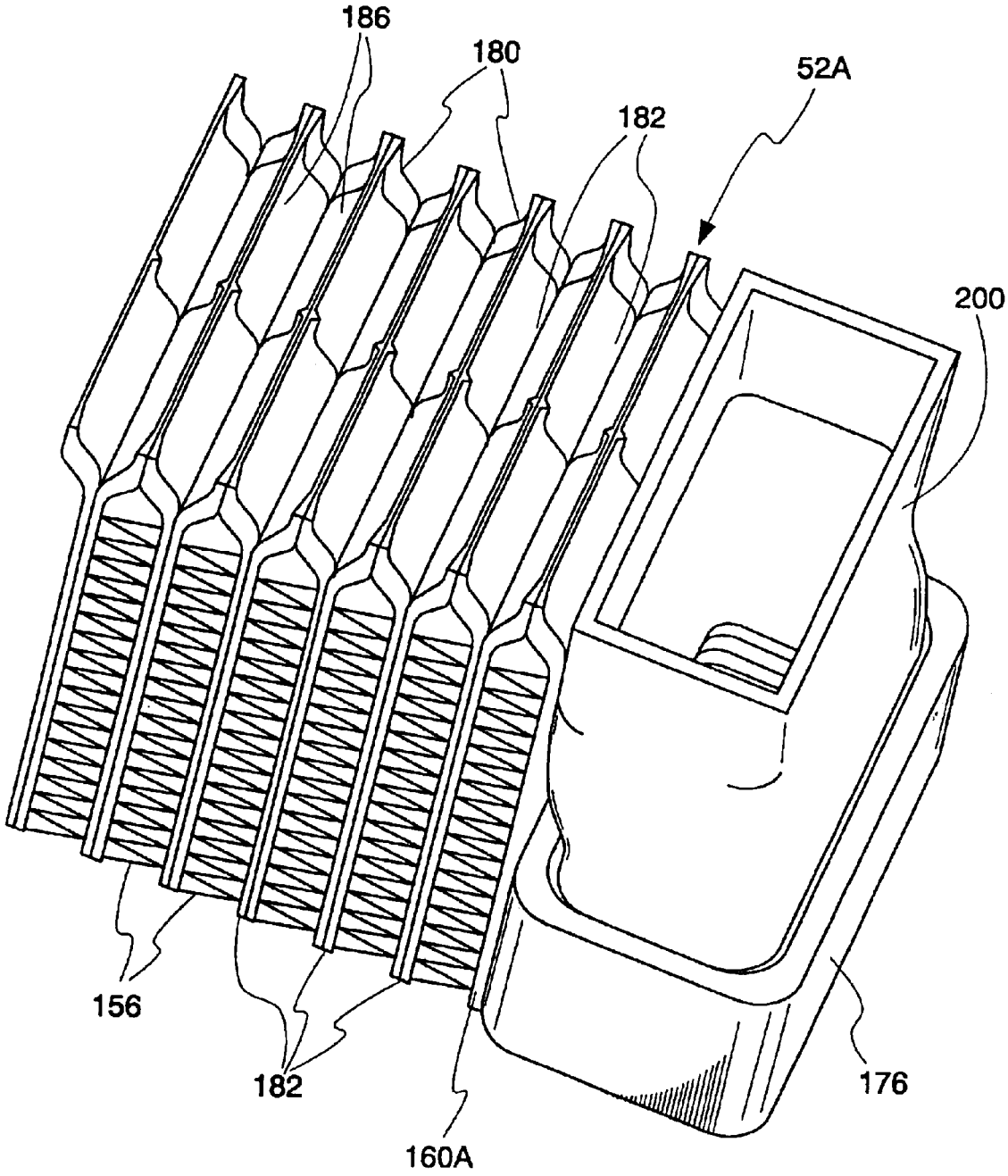
FIG. 11 is perspective partially broken view of the heat exchanger portion illustrated in FIGS. 9–10.

FIGS. 9–11 illustrate another embodiment in which a connector 200 is secured to the header 66, with the tubes of the heat exchanger 52*a* formed by plates 180 secured together at the sides such as is known in the art. Specifically, the plates 180 have a longitudinal flat portion, the sides of which are connected so as to form closed tube passages 182 between secured flat portions. The ends 186 of the plates 180 are bent away from the tube passages 182 and then may be connected to the bent ends 186 of the adjacent flat plate 180 forming one side of the adjacent tube passages 182. Fluid such as coolant is received in a tapered passage 188 between the bent ends 186 and passes from there into the tube passages 182 (or, in the outlet header, would discharge from the tube passages 182 through the tapered passages 188 between the bent ends 186 into the header). Suitable fins 156 are disposed between the tube passages 182, and between the last tube passage of the row and the side piece 160*a*.

In accordance with the invention, the connector 200 is secured proximate to the side piece 160*a*. A slight offset 202 is provided to allow space between the side piece 160*a* for the sleeve 176 connecting the connector to the feed line 64.

Figure 12:
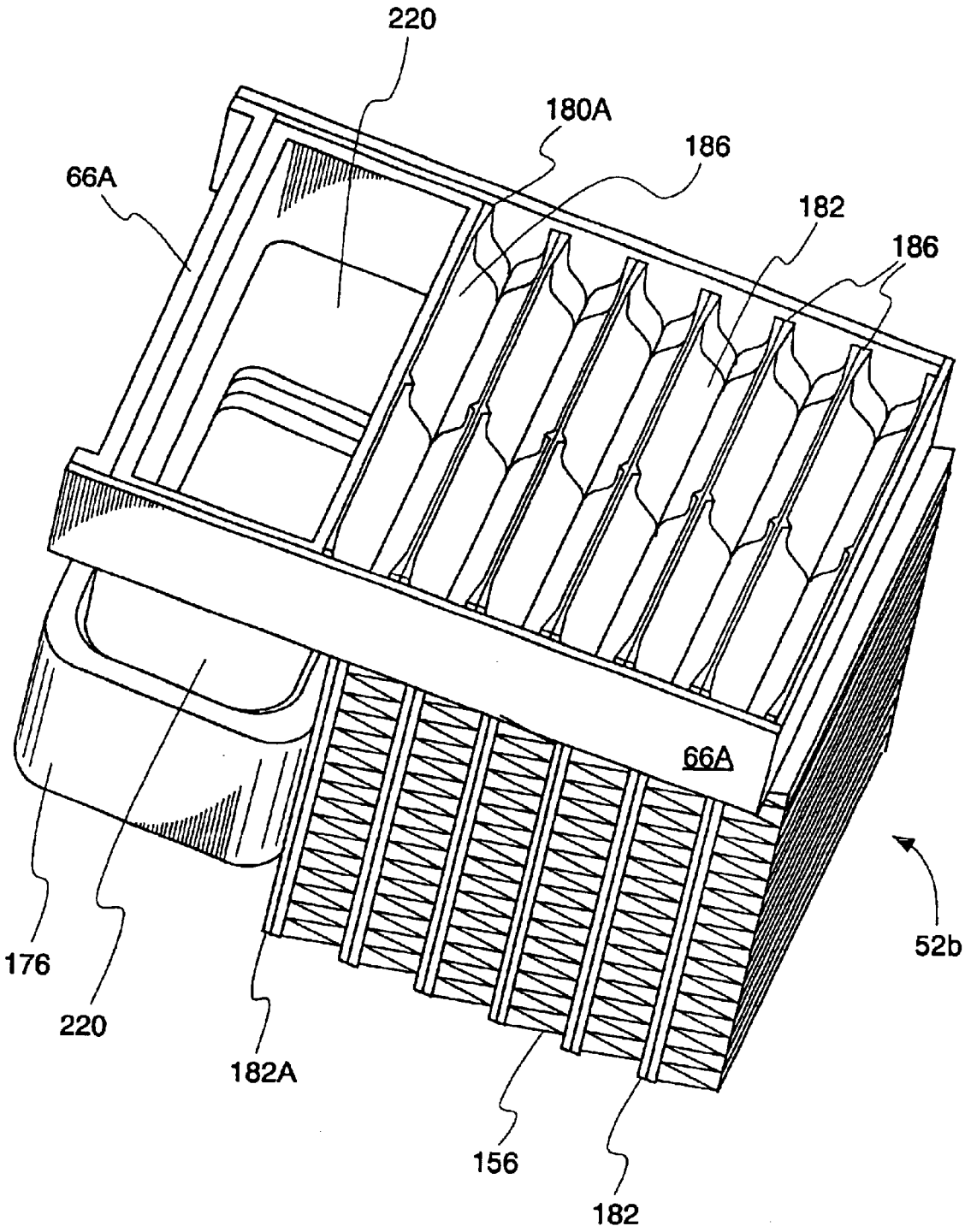
FIG. 12 is a perspective partially broken view of a portion of another heat exchanger usable with the compact cooling system of FIG. 1.

FIG. 12 shows another embodiment, similar to the FIGS. 9–11 configuration, except that the connector 220 is secured in direct proximity to the first tube (i.e., there are no side wall and fins adjacent the last tube passage 182*a*). By providing the last plate 180*a* of the heat exchanger 52*a* with a bent end 186 such as with the other plates 180, a straight connector 220 can be secured directly proximate the plate 180*a* and still provide space for the connecting sleeve 176.

It should be appreciated that the FIGS. 9–12 configurations will, as with the FIG. 6–8 configuration, allow for the feed lines to be secured to the heat exchanger 52*a*, 52*b* without unnecessary protrusion beyond, for example, the generally box-shaped configuration of the compact cooling system 20. In fact, whatever the space requirements in which such heat exchangers 52*a*, 52*b* are being used, the arrangement of the connectors 200, 220 such as shown will ensure that the feed lines which must be connected to the header 66*a* will potentially be of minimal concern inasmuch as the feed lines can be disposed flush against the side of the heat exchanger 52*a*, 52*b* with space being required for only the relatively small thickness of the feed line. Further, such heat exchangers 52*a*, 52*b* can be easily and relatively inexpensively manufactured, as the connectors 200, 220 can be, for example, coated with solder and then secured to the header 66*a* in the same process as tubes are soldered to the header 66*a*.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A compact cooling system, comprising:

a radial fan having an axis, said radial fan directing air flow outwardly away from said fan axis;

a first heat exchanger and a second heat exchanger, said heat exchangers being disposed around said radial fan with first and second headers extending generally in the same direction as said fan axis, said heat exchangers each having:

an inlet in said first header, an outlet in one of said first and second headers, a plurality of flat tubes extending between said first and second headers, said plurality of tubes:

being substantially parallel between first and second end tubes of said plurality of flat tubes, adapted to carry a fluid between said first and second headers, and spaced from a system front to a system back across said air flow, and said first header including a portion extending beyond one of said first and second end tubes whereby said inlet is in said extending portion of said first header;

a system inlet;

a first rectangular tube connecting said system inlet to said inlet in said extending portion of said first heat exchanger, said first rectangular tube being proximate and in line with said one of said first and second end tubes of said first heat exchanger and generally disposed in a space along said fan axis bounded by the ends of said extending portion of said one of said first and second headers of said first heat exchanger; and a second rectangular tube connecting said system inlet to said inlet in said extending portion of said second heat exchanger, said second rectangular tube being proximate and in line with said one of said first and second end tubes of said second heat exchanger and generally disposed in a space along said fan axis bounded by the ends of said extending portion of said one of said first and second headers of said second heat exchanger;

wherein said first and second rectangular tubes have a major dimension and minor dimension, with said minor dimension extending generally parallel to said fan axis.

2. The cooling system of claim 1, wherein said first heat exchanger and said second heat exchanger are disposed with one header of said first heat exchanger against one header of said second heat exchanger whereby air flow between said one headers is prevented.

3. The cooling system of claim 1, further comprising fins between said flat tubes.

4. The cooling system of claim 3, wherein said fins are serpentine.

5. The cooling system of claim 1, wherein said space along said fan axis bounded by the ends of said extending portion of said one of said first and second headers of said first heat exchanger generally coincides with said space along said fan axis bounded by the ends of said extending portion of said one of said first and second headers of said second heat exchanger.

6. The cooling system of claim 1, wherein said minor dimension is generally no larger than the spacing between the ends of said extending portion of said one of said first and second headers of said first and second heat exchangers.

7. The cooling system of claim 1, wherein said first and second rectangular tubes have a flat face extending in the direction of said major dimension, and said flat face is proximate said one of said first and second end tubes.

8. The cooling system of claim 1, further comprising:

a second portion in said one of said first and second headers extending beyond one of said first and second end tubes in said one of said first and second headers of each of said first and second heat exchangers;

a system outlet;

a third rectangular tube connecting said system outlet to said outlet in said second extending portion of said first heat exchanger, said third rectangular tube being proximate and in line with one of said first and second end tubes of said first heat exchanger and generally disposed in a space along said fan axis bounded by the ends of said second extending portion of said one of said first and second headers of said first heat exchanger; and a fourth rectangular tube connecting said system outlet to said outlet in said second extending portion of said second heat exchanger, said second rectangular tube being proximate and in line with said one of said first and second end tubes of said second heat exchanger and generally disposed in a space along said fan axis bounded by the ends of said second extending portion of said one of said first and second headers of said second heat exchanger.

9. The cooling system of claim 8, wherein said first and second rectangular tubes are proximate said first end tubes of said first and second heat exchangers and said third and fourth rectangular tubes are proximate said second end tubes of said first and second heat exchangers.

10. A compact cooling system, comprising:

a radial fan having an axis, said radial fan directing air flow outwardly away from said fan axis;

a first heat exchanger and a second heat exchanger, said heat exchangers being disposed around said radial fan with first and second headers extending generally in the same direction as said fan axis, said heat exchangers each having:

an inlet in said first header, an outlet in one of said first and second headers, a plurality of flat tubes extending between said first and second headers, said plurality of tubes:

being substantially parallel between first and second end tubes of said plurality of flat tubes, adapted to carry a fluid between said first and second headers, and spaced from a system front to a system back across said air flow, and said first header including a portion extending beyond one of said first and second end tubes whereby said inlet is in said extending portion of said first header;

a second portion in said one of said first and second headers extending beyond one of said first and second end tubes in said one of said first and second headers of each of said first and second heat exchangers;

a system inlet;

a system outlet;

a first rectangular tube connecting said system inlet to said inlet in said extending portion of said first heat exchanger, said first rectangular tube being proximate and in line with said one of said first and second end tubes of said first heat exchanger and generally disposed in a space along said fan axis bounded by the ends of said extending portion of said one of said first and second headers of said first heat exchanger; and a second rectangular tube connecting said system inlet to said inlet in said extending portion of said second heat exchanger, said second rectangular tube being proximate and in line with said one of said first and second end tubes of said second heat exchanger and generally disposed in a space along said fan axis bounded by the ends of said extending portion of said one of said first and second headers of said second heat exchanger;

a third rectangular tube connecting said system outlet to said outlet in said second extending portion of said first heat exchanger, said third rectangular tube being proximate and in line with one of said first and second end tubes of said first heat exchanger and generally disposed in a space along said fan axis bounded by the ends of said second extending portion of said one of said first and second headers of said first heat exchanger; and a fourth rectangular tube connecting said system outlet to said outlet in said second extending portion of said second heat exchanger, said second rectangular tube being proximate and in line with said one of said first and second end tubes of said second heat exchanger and generally disposed in a space along said fan axis bounded by the ends of said second extending portion of said one of said first and second headers of said second heat exchanger, wherein said first and second rectangular tubes are proximate said first end tubes of said first and second heat exchangers and said third and fourth rectangular tubes are proximate said second end tubes of said first and second heat exchangers, and said system inlet is at said system front and said system outlet is at said system back.

11. A compact cooling system, comprising:

a radial fan having an axis, said radial fan directing air flow outwardly away from said fan axis;

four heat exchangers, three of said heat exchangers each comprising a plurality of generally flat members joined along longitudinal sides to define tube passages between joined flat members, adjacent flat members defining different tube passages being connected at their ends, said flat members including first and second end flat members between which the other of the plurality of generally flat members are disposed;

first and second headers at opposite ends of said flat members enclosing said defined tube passages;

an inlet in said first header;

an outlet in one of said first and second headers;

one of said first and second headers including a portion extending beyond the first end flat member whereby one of said inlet and outlet is in said extending portion of said one of said first and second headers;

a first rectangular connector for connecting a first exterior line to said one of said inlet and outlet in said header extending portion, said first rectangular connector being proximate and in line with said first end flat member and having a major dimension and a minor dimension, wherein said major dimension generally coincides with the width of the flat members;

said heat exchangers being arranged in a box-shaped envelope about said radial fan with said headers of said heat exchangers extending generally in the same direction as said fan axis with adjacent headers of said heat exchangers being disposed against one another whereby air flow between said adjacent headers is prevented.

12. The cooling system of claim 11, wherein, for each of said three heat exchangers, said minor dimension is generally no larger than the spacing between the ends of said extending portion of said one of said first and second headers of said heat exchanger.

13. The cooling system of claim 11, wherein, for each of said three heat exchangers, said first rectangular connector has a flat face extending in the direction of said major dimension, and said flat face is proximate said first end flat member.

14. The cooling system of claim 11, each of said three heat exchangers further comprising a second rectangular connector for connecting a second exterior line to the other of said inlet and outlet in another header extending portion, said second connector being proximate and in line with the second end flat member.

* * * * *